US008563499B2

(12) United States Patent
Köhle et al.

(10) Patent No.: US 8,563,499 B2
(45) Date of Patent: Oct. 22, 2013

(54) FABRIC SOFTENER ACTIVE COMPOSITION

(75) Inventors: Hans-Jürgen Köhle, Mainhausen (DE); Matthias Schöppner, Bad Soden Salmünster (DE); Axel Euler, Steinau an der Strasse (DE); Harald Jakob, Hasselroth (DE); Saji John Meledathu, Chester, VA (US); Todd L. Kurth, Chester, VA (US); Delbert G. Young, Groveland, IL (US); Ingo Hamann, Chesterfield, VA (US); Georg Schick, Krefeld (DE)

(73) Assignee: Evonik Degussa GmbH, Essen (DE)

( * ) Notice: Subject to any disclaimer, the term of this patent is extended or adjusted under 35 U.S.C. 154(b) by 11 days.

(21) Appl. No.: 13/072,703

(22) Filed: Mar. 26, 2011

(65) Prior Publication Data

US 2011/0245139 A1 Oct. 6, 2011

Related U.S. Application Data

(60) Provisional application No. 61/319,997, filed on Apr. 1, 2010.

(51) Int. Cl.
*C11D 3/60* (2006.01)

(52) U.S. Cl.
USPC ..... 510/515; 510/522; 510/527

(58) Field of Classification Search
USPC ..... 510/515, 522, 527
See application file for complete search history.

(56) References Cited

U.S. PATENT DOCUMENTS

| | | | | |
|---|---|---|---|---|
| 4,234,627 | A | 11/1980 | Schilling | |
| 4,514,461 | A | 4/1985 | Woo | |
| 4,747,880 | A | 5/1988 | Berrido | |
| RE32,713 | E | 7/1988 | Woo | |
| 4,789,491 | A * | 12/1988 | Chang et al. | 510/525 |
| 4,882,220 | A | 11/1989 | Ono et al. | |
| 4,917,920 | A | 4/1990 | Ono et al. | |
| 5,137,646 | A | 8/1992 | Schmidt et al. | |
| 5,391,325 | A | 2/1995 | Swenson | |
| 5,480,567 | A | 1/1996 | Lam et al. | |
| 5,703,029 | A | 12/1997 | Crass | |
| 5,759,990 | A * | 6/1998 | Wahl et al. | 510/515 |
| 5,792,219 | A | 8/1998 | Hartman et al. | |
| 5,827,451 | A | 10/1998 | Cummings | |
| 6,180,593 | B1 | 1/2001 | Fender et al. | |
| 6,200,949 | B1 | 3/2001 | Reijimer et al. | |
| 6,235,914 | B1 | 5/2001 | Steiger | |
| 6,255,274 | B1 | 7/2001 | Becherer | |
| 6,376,455 | B1 * | 4/2002 | Friedli et al. | 510/515 |
| 6,458,343 | B1 * | 10/2002 | Zeman et al. | 424/63 |
| 6,492,322 | B1 | 12/2002 | Cooper et al. | |
| 6,608,024 | B1 * | 8/2003 | DuVal et al. | 510/522 |
| 6,645,479 | B1 | 11/2003 | Shefer et al. | |
| 6,653,275 | B1 * | 11/2003 | Fender et al. | 510/527 |
| 6,770,608 | B2 | 8/2004 | Franklin et al. | |
| 6,897,194 | B2 * | 5/2005 | Fan et al. | 510/527 |
| 6,987,074 | B2 | 1/2006 | Ishii | |
| 7,572,761 | B2 | 8/2009 | Gefvert | |
| 7,704,940 | B2 | 4/2010 | Boerefijin et al. | |
| 7,994,110 | B2 | 8/2011 | Wenk et al. | |
| 8,183,199 | B2 | 5/2012 | Fossum et al. | |
| 2003/0060390 | A1 | 3/2003 | Demeyere et al. | |
| 2003/0158344 | A1 | 8/2003 | Rodrigues et al. | |
| 2003/0165692 | A1 | 9/2003 | Koch et al. | |
| 2003/0195130 | A1 | 10/2003 | Lentsch et al. | |
| 2003/0195133 | A1 | 10/2003 | Shefer et al. | |
| 2003/0203829 | A1 | 10/2003 | Shefer et al. | |
| 2003/0215417 | A1 | 11/2003 | Uchiyama et al. | |
| 2003/0216282 | A1 | 11/2003 | Martens et al. | |
| 2003/0216488 | A1 | 11/2003 | Uchiyama et al. | |
| 2003/0220210 | A1 | 11/2003 | DuVal et al. | |
| 2004/0071742 | A1 | 4/2004 | Popplewell et al. | |
| 2004/0071746 | A1 | 4/2004 | Popplewell et al. | |
| 2004/0072719 | A1 | 4/2004 | Bennett et al. | |

(Continued)

FOREIGN PATENT DOCUMENTS

| | | |
|---|---|---|
| CA | 1312619 | 1/1993 |
| CS | 246532 | 3/1986 |

(Continued)

OTHER PUBLICATIONS

International Search Report for PCT/EP2011/054282 filed Mar. 22, 2011.
Written Opinion of the International Searching Authority for PCT/EP2011/054282 filed Mar. 22, 2011.
English language abstract for DE 34 02 146 A1.
English language abstract for WO2009/018955 A2.
Second English language abstract for WO2009/018955 A2.
English language abstract for DE 24 30 140.
English language abstract for DE 36 08 093.
English language abstract for EP 1 018 541.
U.S. Appl. No. 13/072,701, filed Mar. 26, 2011, Köhle.

(Continued)

*Primary Examiner* — Mark Eashoo
*Assistant Examiner* — M. Reza Asdjodi
(74) *Attorney, Agent, or Firm* — Law Office of: Michael A. Sanzo, LLC

(57) ABSTRACT

A fabric softener active composition, comprising from 65 to 95% by weight of a bis-(2-hydroxyethyl)-dimethylammonium chloride fatty acid ester having a molar ratio of fatty acid moieties to amine moieties of from 1.80 to 1.96, an average chain length of the fatty acid moieties of from 16 to 18 carbon atoms and an iodine value of from 0 to 50, from 2 to 8% by weight of a fatty acid triglyceride having an average chain length of the fatty acid moieties of from 10 to 14 carbon atoms and an iodine value of from 0 to 15, and from 3 to 12% by weight of an alcohol selected from ethanol, 1-propanol and 2-propanol has low melt viscosity, high stability towards dealkylation in the molten state and low flammability.

18 Claims, No Drawings

(56) References Cited

U.S. PATENT DOCUMENTS

| | | | | |
|---|---|---|---|---|
| 2004/0072720 | A1 | 4/2004 | Brain et al. | |
| 2004/0087477 | A1 | 5/2004 | Ness | |
| 2004/0106536 | A1 | 6/2004 | Mane et al. | |
| 2004/0167056 | A1 | 8/2004 | Lentsch et al. | |
| 2004/0204337 | A1 | 10/2004 | Corona et al. | |
| 2005/0014672 | A1 | 1/2005 | Arif | |
| 2005/0032671 | A1 | 2/2005 | Kvita et al. | |
| 2006/0089293 | A1* | 4/2006 | Frankenbach | 510/515 |
| 2006/0094639 | A1 | 5/2006 | Martin et al. | |
| 2006/0142175 | A1 | 6/2006 | Haiss et al. | |
| 2006/0277689 | A1 | 12/2006 | Hubig et al. | |
| 2007/0054835 | A1* | 3/2007 | Corona et al. | 510/515 |
| 2007/0066510 | A1 | 3/2007 | Tee et al. | |
| 2007/0219111 | A1 | 9/2007 | Ward et al. | |
| 2008/0242584 | A1* | 10/2008 | Wahl et al. | 510/517 |
| 2008/0263780 | A1* | 10/2008 | Declercq et al. | 8/137 |
| 2008/0289116 | A1 | 11/2008 | Young et al. | |
| 2009/0124533 | A1 | 5/2009 | Kottke et al. | |
| 2009/0181877 | A1 | 7/2009 | McGinnis et al. | |
| 2009/0203571 | A1* | 8/2009 | Nagy et al. | 510/525 |
| 2011/0110993 | A1 | 5/2011 | Chieffi et al. | |
| 2011/0239377 | A1 | 10/2011 | Fossum et al. | |
| 2011/0239378 | A1 | 10/2011 | Fossum et al. | |
| 2011/0245138 | A1 | 10/2011 | Köhle et al. | |
| 2011/0245140 | A1 | 10/2011 | Demeyere | |
| 2012/0088712 | A1 | 4/2012 | Schick et al. | |

FOREIGN PATENT DOCUMENTS

| | | | |
|---|---|---|---|
| DE | 24 30 140 | A1 | 2/1976 |
| DE | 34 02 146 | A1 | 7/1985 |
| DE | 36 08 093 | A1 | 9/1987 |
| DE | 197 08 133 | | 12/1997 |
| EP | 0 284 036 | | 9/1988 |
| EP | 0 293 955 | A2 | 12/1988 |
| EP | 0 302 567 | A2 | 2/1989 |
| EP | 0 421 146 | A2 | 9/1990 |
| EP | 0 829 531 | A1 | 3/1998 |
| EP | 1 018 541 | A1 | 7/2000 |
| EP | 1 323 817 | A1 | 12/2001 |
| EP | 1 393 706 | A1 | 3/2004 |
| EP | 1 840 197 | A1 | 2/2007 |
| GB | 2 007 734 | A | 5/1979 |
| GB | 2 039 556 | | 8/1980 |
| WO | WO 91/01295 | | 2/1991 |
| WO | WO 92/18593 | | 10/1992 |
| WO | WO 94/14935 | | 7/1994 |
| WO | WO 94/19439 | | 9/1994 |
| WO | WO 98/38277 | | 9/1998 |
| WO | WO 00/06678 | | 2/2000 |
| WO | WO 2005/085404 | A1 | 9/2005 |
| WO | WO 2007/026314 | A2 | 3/2007 |
| WO | WO 2007/125005 | | 11/2007 |
| WO | WO 2008/104509 | | 9/2008 |
| WO | WO 2009/018955 | A2 | 2/2009 |
| WO | WO 2011/120836 | A1 | 10/2011 |
| WO | WO 2011/123284 | A1 | 10/2011 |
| WO | WO 2011/123606 | A1 | 10/2011 |
| WO | WO 2011/123733 | A1 | 10/2011 |

OTHER PUBLICATIONS

International Search Report for PCT/EP2011/054107 filed Mar. 18, 2011, which is the international counterpart of copending U.S. Appl. No. 13/072,701.

Written Opinion of the International Searching Authority for PCT/EP2011/054107 filed Mar. 18, 2011.

English language abstract for EP 0 421 146 A2.

English language abstract for EP 1 323 817 A1.

English language translation of CS 246532.

English language abstract for DE 197 08 133.

English language abstract for EP 0 284 036.

English language abstract for WO 91/01295.

English language abstract for WO 94/14935.

English language abstract for WO 2007/125005.

Preliminary Amendment filed for copending U.S. Appl. No. 13/643,486 on Oct. 25, 2012.

U.S. Appl. No. 13/603,000, filed Sep. 4, 2012, Nagy.

U.S. Appl. No. 13/643,486, filed Oct. 25, 2012, Köhle.

Office Action mailed Jun. 20, 2012 in the prosecution of copending U.S. Appl. No. 13/072,701.

Response filed Oct. 9, 2012 in the prosecution of copending U.S. Appl. No. 13/072,701.

Ullman's Encyclopedia of Industrial Chemistry; Wiley-VCH Verlag GmbH & Co. KGaA, Weinheim, vol. 14, Table 2, p. 77 (2012).

Price-Jones, et al., "N,N'-ethylenediyl-bis-alkanamides: Differential scanning calorimetry studies," *J. Am. Oil Chem. Soc. 73*:311-319 (1996).

Product Advertisement for Tetranyl AO-1, http//kaochemicals-eu.com/213.html, downloaded Jul. 27, 2011.

U.S. Appl. No. 13/168,958, filed Jun. 25, 2011, Schick.

* cited by examiner

FABRIC SOFTENER ACTIVE COMPOSITION

CROSS REFERENCE TO RELATED APPLICATIONS

The present application claims the benefit of U.S. provisional application 61/319,997, filed on Apr. 1, 2010.

FIELD OF THE INVENTION

The present invention relates to fabric softener active compositions having a low content of flammable solvents, a low melt viscosity and high stability in a molten state.

BACKGROUND OF THE INVENTION

Quaternary ammonium salts carrying two hydrophobic long chain hydrocarbon moieties have found broad use as fabric softener actives. Quaternary ammonium salts of alkanolamines esterified with on average two fatty acid moieties per molecule, commonly referred to as ester quats, have largely replaced earlier alkyl quaternary ammonium compounds because of their biodegradability.

Bis-(2-hydroxyethyl)-dimethylammonium chloride fatty acid diesters, which have found commercial use, are difficult to handle in a pure state, since the solid tends to lump and the melt has high viscosity at low melt temperatures and unsatisfactory stability at higher melt temperatures. Therefore, bis-(2-hydroxyethyl)-dimethylammonium chloride fatty acid diesters are usually shipped as a molten composition containing at least 13% by weight of ethanol or 2-propanol, which has a viscosity at temperatures of 65 to 75° C. that is sufficiently low for pumping. However, such compositions have a low flash point of less than 30° C. and are therefore subject to regulatory restrictions and require additional safety measures in handling.

WO 2007/026314 proposes to replace the flammable solvent of such compositions by 2 to 40% by weight of a diluent chosen from alkyl esters or polyesters, alkyl amides or polyamides, fatty acids, nonionics or combinations thereof and specifically discloses hydrogenated tallow fat, hydrogenated tallow fatty acid, hydrogenated coconut oil, hydrogenated palm stearine, hydrogenated soy oil, ethylene glycol distearate hard soy sucrose ester, cetyl palmitate and pentaerythritol tetracaprylate/tetracaprate as suitable diluents. WO 2007/026314 further proposes to use an additional coupling agent, selected from polyhydric alcohols, partial esters of polyhydric alcohols non-ionic surfactants, in an amount of from 0.1 to 15% by weight. However, the compositions taught by WO 2007/026314 have the disadvantage of a low stability in the molten state with respect to dealkylation of the quaternary ammonium salt, which leads to an increase in the content of free ester amine during transport and handling in a molten state.

Therefore, there is still a need for fabric softener active compositions which have a low melt viscosity and high stability in a molten state and at the same time have a low flammability.

DESCRIPTION OF THE INVENTION

It has now been found that fabric softener active compositions based on a bis-(2-hydroxyethyl)-dimethyl-ammonium chloride fatty acid ester made from fatty acids with a specific chain length and a specific degree of unsaturation and having a particular molar ratio of fatty acid moieties to amine moieties, which comprise a specific amount of a fatty acid triglyceride, having a specific lower chain length of the fatty acid moieties, as well as a specific amount of an alcohol, selected from ethanol, 1-propanol and 2-propanol, show an unexpected combination of low melt viscosity, high stability towards dealkylation in the molten state and low flammability.

The present invention is therefore directed to a fabric softener active composition, comprising a) from 65 to 95% by weight of a bis-(2-hydroxyethyl)-dimethylammonium chloride fatty acid ester having a molar ratio of fatty acid moieties to amine moieties of from 1.80 to 1.96, an average chain length of the fatty acid moieties of from 16 to 18 carbon atoms and an iodine value, calculated for the free fatty acid, of from 0 to 50, b) from 2 to 8% by weight of a fatty acid triglyceride having an average chain length of the fatty acid moieties of from 10 to 14 carbon atoms and an iodine value, calculated for the free fatty acid, of from 0 to 15, and c) from 3 to 12% by weight of an alcohol selected from ethanol, 1-propanol and 2-propanol.

The invention is further directed to a method for making such compositions, comprising the steps a) reacting a mixture comprising from 78 to 95% by weight bis-(2-hydroxyethyl)-methylamine fatty acid ester having a molar ratio of fatty acid moieties to amine moieties of from 1.80 to 1.96, an average chain length of the fatty acid moieties of from 16 to 18 carbon atoms and an iodine value, calculated for the free fatty acid, of from 0 to 50, from 2 to 9% by weight of a fatty acid triglyceride having an average chain length of the fatty acid moieties of from 10 to 14 carbon atoms and an iodine value, calculated for the free fatty acid, of from 0 to 15, and from 3 to 13% by weight of an alcohol selected from ethanol, 1-propanol and 2-propanol with an excess of methyl chloride at a temperature of from 60 to 120° C. to provide a reaction mixture, and b) separating unreacted methyl chloride from the reaction mixture of step a) by distilling off a mixture of methyl chloride and said alcohol, condensing alcohol from said mixture of methyl chloride and alcohol and returning condensed alcohol to said reaction mixture to provide a content of alcohol of from 3 to 12% by weight.

The invention is also directed to an alternative method for making such compositions, comprising the steps a) reacting a mixture comprising from 88 to 98% by weight bis-(2-hydroxyethyl)-methylamine fatty acid ester having a molar ratio of fatty acid moieties to amine moieties of from 1.80 to 1.96, an average chain length of the fatty acid moieties of from 16 to 18 carbon atoms and an iodine value, calculated for the free fatty acid, of from 0 to 50, from 2 to 9% by weight of a fatty acid triglyceride having an average chain length of the fatty acid moieties of from 10 to 14 carbon atoms and an iodine value, calculated for the free fatty acid, of from 0 to 15, and from 0 to 3% by weight of an alcohol selected from ethanol, 1-propanol and 2-propanol with an excess of methyl chloride at a temperature of from 60 to 120° C. to provide a reaction mixture, b) adding more of the alcohol to the reaction mixture of step a) to provide a content of alcohol of from 3 to 12% by weight, and c) separating unreacted methyl chloride from the mixture of step b) by distilling off a mixture of methyl chloride and said alcohol, condensing alcohol from said mixture of methyl chloride and alcohol and returning condensed alcohol to said reaction mixture to provide a content of alcohol of from 3 to 12% by weight.

The fabric softener active composition of the invention comprises from 65 to 95% by weight of bis-(2-hydroxyethyl)-dimethylammonium chloride fatty acid ester The composition preferably comprises from 80 to 90% by weight of said ester.

The bis-(2-hydroxyethyl)-dimethylammonium chloride fatty acid ester comprises at least one diester of formula $(CH_3)_2N^+(CH_2CH_2OC(=O)R)_2\ Cl^-$ and at least one monoester of formula $(CH_3)_2N^+(CH_2CH_2OH)(CH_2CH_2C(=O)R)\ Cl^-$, where R is the hydrocarbon group of a fatty acid moiety RCOO. The bis-(2-hydroxyethyl)-dimethylammonium chloride fatty acid ester has a molar ratio of fatty acid moieties to amine moieties of from 1.80 to 1.96 and preferably from 1.85 to 1.94. The specified molar ratio provides high softening performance in a rinse cycle fabric softener.

The fatty acid moiety of the bis-(2-hydroxyethyl)-dimethylammonium chloride fatty acid ester can be derived from a pure fatty acid or a mixture of fatty acids of formula RCOOH, where R is a hydrocarbon group. The hydrocarbon group may be branched or unbranched and preferably is unbranched.

The fatty acid moiety has an average chain length of from 16 to 18 carbon atoms and an iodine value, calculated for the free fatty acid, of from 0 to 50. The average chain length is preferably from 16.5 to 17.8 carbon atoms. Preferably, the fatty acid moiety has an iodine value of from 1.0 to 50, more preferably of from 2 to 50, even more preferably of from 5 to 40 and most preferably of from 15 to 35. The average chain length is calculated on the basis of the weight fraction of individual fatty acids in the mixture of fatty acids. For branched chain fatty acids the chain length refers to the longest consecutive chain of carbon atoms. The iodine value is the amount of iodine in g consumed by the reaction of the double bonds of 100 g of fatty acid, determined by the method of ISO 3961. In order to provide the required average chain length and iodine value, the fatty acid moiety can be derived from a mixture of fatty acids comprising both saturated and unsaturated fatty acids. The unsaturated fatty acids are preferably monounsaturated fatty acids. The bis-(2-hydroxyethyl)-dimethylammonium chloride fatty acid ester preferably comprises less than 6% by weight of multiply unsaturated fatty acid moieties. Examples of suitable saturated fatty acids are palmitic acid and stearic acid. Examples of suitable monounsaturated fatty acids are oleic acid and elaidic acid. The cis-trans-ratio of double bonds of unsaturated fatty acid moieties is preferably higher than 55:45 and more preferably higher than 65:35. The fraction of multiply unsaturated fatty acid moieties may be reduced by selective touch hydrogenation, which is a hydrogenation that selectively hydrogenates one double bond in a —CH=CH—$CH_2$—CH=CH— substructure but not double bonds of monounsaturated hydrocarbon groups. The specified average chain length and iodine values are essential for simultaneously achieving high softening performance and low melting point of the composition. If the average chain length is less than 16 carbon atoms or the iodine value is higher than 50, the softening performance will be unsatisfactory, whereas the melting point of the composition can get too high if the average chain length is more than 18 carbon atoms.

The fatty acid moiety may be derived from fatty acids of natural or synthetic origin and is preferably derived from fatty acids of natural origin, most preferably from tallow fatty acid. The required iodine value can be provided by using a fatty acid mixture of natural origin that already has such an iodine value, for example a tallow fatty acid. Alternatively, the required iodine value can be provided by partial hydrogenation of a fatty acid mixture or a triglyceride mixture having a higher iodine value. In a further and preferred embodiment, the required iodine value is provided by mixing a fatty acid mixture having a higher iodine value with a mixture of saturated fatty acids. The mixture of saturated fatty acids may be obtained either by hydrogenating a fatty acid mixture containing unsaturated fatty acids or from a hydrogenated triglyceride mixture, such as a hydrogenated vegetable oil.

The fabric softener active composition of the present invention further comprises from 2 to 8% by weight and preferably from 3 to 6% by weight of a fatty acid triglyceride having an average chain length of the fatty acid moieties of from 10 to 14 carbon atoms and an iodine value, calculated for the free fatty acid, of from 0 to 15. The average chain length of the fatty acid moieties is preferably from 12 to 13.8 carbon atoms. The fatty acid triglyceride is preferably a coconut oil or a hydrogenated coconut oil and most preferably a refined coconut oil. The specified amount of fatty acid triglyceride and average chain length of the fatty acid moieties is essential for simultaneously achieving low melting point and low flammability of the fabric softener active composition. Surprisingly, the specified amount of fatty acid triglyceride also improves the softening efficiency of a rinse cycle softener prepared from the fabric softener active composition of the present invention.

The fabric softener active composition of the present invention also comprises from 3 to 12% by weight and preferably from 6 to 10% by weight of an alcohol selected from ethanol, 1-propanol and 2-propanol. The alcohol is preferably ethanol or 2-propanol and most preferably 2-propanol. The specified amount of alcohol is essential for simultaneously achieving low flammability of the fabric softener active composition and high stability of the composition in the molten state towards dealkylation of the bis-(2-hydroxyethyl)-dimethylammonium chloride fatty acid ester. The improvement in stability that can be achieved by the specified amount of alcohol appears to be specific for the chloride salt and has not been recognized in the prior art.

The combined amount of fatty acid triglyceride and the alcohol is preferably from 10 to 15% by weight.

The fabric softener active compositions of the present invention show a combination of high stability towards dealkylation in the molten state, low melt viscosity and low flammability. A fabric softener active composition comprising 86% by weight bis-(2-hydroxyethyl)-dimethyl-ammonium chloride tallow fatty acid ester, 3% by weight coconut oil and 9% by weight 2-propanol has a flash point of 38° C. determined according to DIN 53213.

The fabric softener active composition of the present invention can be prepared by mixing bis-(2-hydroxyethyl)-dimethylammonium chloride fatty acid ester, fatty acid triglyceride and alcohol in the specified amounts. However, the fabric softener active composition is preferably prepared by one of the two methods of the invention, which share the quaternisation of a bis-(2-hydroxyethyl)-methylamine fatty acid ester with excess methyl chloride in the presence of the fatty acid triglyceride and the subsequent separation of excess methyl chloride in the presence of the alcohol.

The first method of the invention comprises two steps. In the first step, a mixture comprising from 78 to 95% by weight bis-(2-hydroxyethyl)-methylamine fatty acid ester, from 2 to 9% by weight of a fatty acid triglyceride and from 3 to 13% by weight of an alcohol selected from ethanol, 1-propanol and 2-propanol are reacted with an excess of methyl chloride at a temperature of from 60 to 120° C. and preferably from 90 to 110° C. The molar amount of methyl chloride is larger than the molar amount of bis-(2-hydroxyethyl)-methylamine fatty acid ester and the molar ratio of methyl chloride to bis-(2-hydroxyethyl)-methylamine fatty acid ester is preferably from 1.1 to 1.5. The bis-(2-hydroxyethyl)-methylamine fatty acid ester has a molar ratio of fatty acid moieties to amine moieties of from 1.80 to 1.96, preferably from 1.82 to 1.92, an average chain length of the fatty acid moieties of from 16 to 18 carbon atoms, preferably from 16.5 to 17.8 carbon atoms, and an iodine value, calculated for the free fatty acid, of from 0 to 50, preferably from 1.0 to 50, more preferably of from 2 to 50, even more preferably of from 5 to 40 and most preferably of from 15 to 35. The fatty acid triglyceride has an average chain length of the fatty acid moieties of from to 14 carbon atoms, preferably from 12 to 13.8 carbon atoms, and an iodine value, calculated for the free fatty acid, of from 0 to 15 and is preferably a coconut oil or a hydrogenated coconut oil. The reaction is preferably carried out in a pressure vessel at a total pressure of from 1 to 10 bar, preferably 3 to 8 bar. The methyl chloride is preferably added to the mixture of bis-(2-hydroxyethyl)-methylamine fatty acid ester, fatty acid triglyceride and alcohol at a rate that avoids an increase of pressure beyond the specified upper limit. The reaction is preferably carried out until more than 80%, preferably more than 85% of the bis-(2-hydroxyethyl)-methylamine fatty acid ester has reacted. Suitable reaction times are in the range from 2 to 8 h depending on the reaction temperature and pressure.

In the second step, unreacted methyl chloride is separated from the reaction mixture of step a) by distilling off a mixture of methyl chloride and the alcohol, condensing alcohol from the mixture of methyl chloride and alcohol that distills off and returning condensed alcohol to the reaction mixture to provide a content of alcohol of from 3 to 12% by weight in the reaction mixture. The mixture of methyl chloride and alcohol is preferably distilled off at a total pressure of from 0.2 to 1 bar. The alcohol is preferably condensed from the mixture of methyl chloride and alcohol in a partial condenser at a temperature between the boiling points of methyl chloride and the alcohol at the pressure employed for the distillation. All or a part of the condensed alcohol may be returned to the reaction mixture, depending on the content of alcohol that is desired for the resulting mixture.

The second method of the invention comprises three steps and differs from the first method of the invention in that in the first step the initial mixture comprises from 88 to 98% by weight bis-(2-hydroxyethyl)-methylamine fatty acid ester and from 0 to 3% by weight of the alcohol and in that in an additional step more of the alcohol is added to the reaction mixture of the first step to provide a content of alcohol of from 3 to 12% by weight, before the step of separating unreacted methyl chloride from the mixture is carried out.

The two methods of the invention have the advantage of providing a fabric softener active composition having a low content of non-quaternized bis-(2-hydroxyethyl)-methylamine fatty acid ester at short reaction times. The second method of the invention has the additional advantage of low byproduct formation from alkylation of the alcohol and a further reduced alkylation reaction time.

The invention is illustrated by the following examples, which are however not intended to limit the scope of the invention in any way.

EXAMPLES

Fabric softener active compositions were prepared from coconut oil, 2-propanol and a bis-(2-hydroxyethyl)-dimethylammonium chloride tallow fatty acid ester with an iodine value of 20, calculated for the free fatty acid, having a molar ratio of fatty acid moieties to amine moieties of 1.89 and containing 0.044 mmol/g bis-(2-hydroxyethyl)-methylamine fatty acid ester, 0.041 mmol/g bis-(2-hydroxyethyl)-methylammonium chloride fatty acid ester and 0.111 mmol/g fatty acid by mixing the powdered quaternary ammonium salt with the solvents in the amounts given in table 1 and melting the mixtures.

Storage stability was determined for fabric softener active compositions that were stored for 5 days at 100° C. in closed glass bottles.

Melt viscosities were measured at 90° C. with a StressTech rheometer of REOLOGICA® instruments using 50 mm parallel plates, a plate distance of 1 mm and shear rates of 1, 10 and 100 $s^{-1}$.

TABLE 1

Properties of fabric softener active compositions

| Example | 1* | 2* | 3 |
|---|---|---|---|
| Fraction quat:coconut oil:2-propanol in % by weight | 92:0:8 | 96:4:0 | 88:4:8 |
| Melt viscosity at 1 $s^{-1}$ in mPa*s | 272 | 13200 | 262 |
| Melt viscosity at 10 $s^{-1}$ in mPa*s | 237 | 9010 | 236 |
| Melt viscosity at 100 $s^{-1}$ in mPa*s | 219 | 2290 | 194 |
| Fraction of quat dealkylated after 5 d storage at 100° C. in % | 7, 8 | 10, 0 | 7, 9 |

*Not according to the invention

What is claimed is:

1. A fabric softener active composition, comprising:

a) from 65 to 95% by weight of a bis-(2-hydroxyethyl)-dimethylammonium chloride fatty acid ester, having a molar ratio of fatty acid moieties to amine moieties of from 1.80 to 1.96, an average chain length of the fatty acid moieties of from 16 to 18 carbon atoms and an iodine value, calculated for the free fatty acid, of from 0 to 50;

b) from 2 to 8% by weight of a fatty acid triglyceride having an average chain length of the fatty acid moieties of from 10 to 14 carbon atoms and an iodine value, calculated for the free fatty acid, of from 0 to 15; and c) from 3 to 12% by weight of an alcohol selected from ethanol, 1-propanol and 2-propanol.

2. The fabric softener active composition of claim 1, comprising from 3 to 6% by weight of said fatty acid triglyceride.

3. The fabric softener active composition of claim 2, comprising from 6 to 10% by weight of said alcohol.

4. The fabric softener active composition of claim 3, wherein the fatty acid triglyceride is a coconut oil or a hydrogenated coconut oil.

5. The fabric softener active composition of claim 4, wherein the fatty acid moieties of the bis-(2-hydroxyethyl)-dimethylammonium chloride fatty acid ester have an iodine value, calculated for the free fatty acid, of from 15 to 35.

6. The fabric softener active composition of claim 3, wherein the fatty acid moieties of the bis-(2-hydroxyethyl)-dimethylammonium chloride fatty acid ester have an iodine value, calculated for the free fatty acid, of from 15 to 35.

7. The fabric softener active composition of claim 3, wherein the combined amount of said fatty acid triglyceride and said alcohol is from 10 to 15% by weight.

8. The fabric softener active composition of claim 7, wherein the fatty acid triglyceride is a coconut oil or a hydrogenated coconut oil.

9. The fabric softener active composition of claim 8, wherein the fatty acid moieties of the bis-(2-hydroxyethyl)-dimethylammonium chloride fatty acid ester have an iodine value, calculated for the free fatty acid, of from 15 to 35.

10. The fabric softener active composition of claim 1, wherein the combined amount of said fatty acid triglyceride and said alcohol is from 10 to 15% by weight.

11. The fabric softener active composition of claim 10, wherein the fatty acid moieties of the bis-(2-hydroxyethyl)-dimethylammonium chloride fatty acid ester have an iodine value, calculated for the free fatty acid, of from 15 to 35.

12. The fabric softener active composition of claim 1, wherein the fatty acid triglyceride is a coconut oil or a hydrogenated coconut oil.

13. The fabric softener active composition of claim 12, wherein the fatty acid moieties of the bis-(2-hydroxyethyl)-dimethylammonium chloride fatty acid ester have an iodine value, calculated for the free fatty acid, of from 15 to 35.

14. The fabric softener active composition of claim 1, wherein the fatty acid moieties of the bis-(2-hydroxyethyl)-dimethylammonium chloride fatty acid ester have an iodine value, calculated for the free fatty acid, of from 15 to 35.

15. A method for making a fabric softener active composition according to claim 1, comprising the steps:

a) reacting a mixture comprising from 78 to 95% by weight bis-(2-hydroxyethyl)-methylamine fatty acid ester having a molar ratio of fatty acid moieties to amine moieties of from 1.80 to 1.96, an average chain length of the fatty acid moieties of from 16 to 18 carbon atoms and an iodine value, calculated for the free fatty acid, of from 0 to 50, from 2 to 9% by weight of a fatty acid triglyceride having an average chain length of the fatty acid moieties of from 10 to 14 carbon atoms and an iodine value, calculated for the free fatty acid, of from 0 to 15, and from 3 to 13% by weight of an alcohol selected from ethanol, 1-propanol and 2-propanol with an excess of methyl chloride at a temperature of from 60 to 120° C. to provide a reaction mixture, and b) separating unreacted methyl chloride from the reaction mixture of step a) by distilling off a mixture of methyl chloride and said alcohol, condensing alcohol from said mixture of methyl chloride and alcohol and returning condensed alcohol to said reaction mixture to provide a content of alcohol of from 3 to 12% by weight.

16. The method of claim 15, wherein the mixture of methyl chloride and alcohol is distilled off at a total pressure of from 0.2 to 1 bar.

17. A method for making a fabric softener active composition according to claim 1, comprising the steps a) reacting a mixture comprising from 88 to 98% by weight bis-(2-hydroxyethyl) -methylamine fatty acid ester having a molar ratio of fatty acid moieties to amine moieties of from 1.80 to 1.96, an average chain length of the fatty acid moieties of from 16 to 18 carbon atoms and an iodine value, calculated for the free fatty acid, of from 0 to 50, from 2 to 9% by weight of a fatty acid triglyceride having an average chain length of the fatty acid moieties of from 10 to 14 carbon atoms and an iodine value, calculated for the free fatty acid, of from 0 to 15, and from 0 to 3% by weight of an alcohol selected from ethanol, 1-propanol and 2-propanol with an excess of methyl chloride at a temperature of from 60 to 120° C. to provide a reaction mixture, b) adding more of the alcohol to the reaction mixture of step a) to provide a content of alcohol of from 3 to 12% by weight, and c) separating unreacted methyl chloride from the mixture of step b) by distilling off a mixture of methyl chloride and said alcohol, condensing alcohol from said mixture of methyl chloride and alcohol and returning condensed alcohol to said reaction mixture to provide a content of alcohol of from 3 to 12% by weight.

18. The method of claim 17, wherein the mixture of methyl chloride and alcohol is distilled off at a total pressure of from 0.2 to 1 bar.

* * * * *